United States Patent [19]

Pearl

[11] 4,112,797

[45] Sep. 12, 1978

[54] FLUID JET CUTTING APPARATUS

[75] Inventor: David R. Pearl, West Hartford, Conn.

[73] Assignee: Gerber Garment Technology, Inc., South Windsor, Conn.

[21] Appl. No.: 840,273

[22] Filed: Oct. 7, 1977

[51] Int. Cl.[2] ..... B26F 3/00; D06H 7/00

[52] U.S. Cl. ..... 83/177; 83/648; 83/658; 83/925 CC

[58] Field of Search ..... 83/177, 53, 925 CC, 83/658, 648

[56] References Cited

U.S. PATENT DOCUMENTS 3,877,334 4/1975 Gerber ..... 83/177 X

*Primary Examiner*—J. M. Meister

*Attorney, Agent, or Firm*—McCormick, Paulding & Huber

[57] ABSTRACT

A fluid jet cutting apparatus comprises a computer positioned fluid jet cutting tool supported for movement above and relative to a bed of parallel plates which have upper knife edge portions disposed in a common plane to define a fluid penetrable material supporting surface. Energy absorbing material such as liquid, and/or metal wool, gravel or shot may be disposed below the material supporting surface and between the bed plates to absorb residual energy from the fluid jet cutting stream after it has cut through material resting on the supporting surface.

23 Claims, 8 Drawing Figures

FLUID JET CUTTING APPARATUS

BACKGROUND OF THE INVENTION

This invention relates in general to cutting apparatus and deals more particularly with improved high velocity fluid jet cutting apparatus particularly suitable for automatic production cutting of sheet material such as woven and nonwoven fabric, plastic, leather, rubber and the like. In an apparatus of the aforedescribed general type a high pressure fluid jet stream, focused by a nozzle, functions as an omnidirectional cutting "blade" to form a narrow kerf. Such apparatus is particularly suitable for cutting intricate shapes from lay-ups of sheet material in ply heights from one to several hundred. The lay-up to be cut must lie flat for accurate cutting and must be supported locally from beneath in the area where the fluid jet pierces the lower layers of the lay-up so that these layers are cut cleanly and not pushed down by the jet forces. However, the high pressure fluid jet stream, which travel at supersonic speed as it leaves the jet nozzle of the cutting tool, must retain its integrity as it passes through the lower layers of material and, therefore, necessarily has considerable residual energy as it leaves the lowermost layer of material which it has cut. This residual energy poses a potential source of wear to the cutting apparatus and backsplash damage to the material being cut and more particularly damage to the lowermost layers of material which comprise a lay-up being cut. Some provision must be made to dissipate this residual energy and drain off or otherwise recirculate the cutting fluid in the apparatus without excessive wear, noise or backsplash. The present invention is concerned with these problems.

SUMMARY OF THE INVENTION

In accordance with the present invention, apparatus for cutting material comprises a bed assembly which includes a plurality of spaced apart bed plates which have sharp upper edge portions disposed in a common generally horizontal plane to define a fluid permeable material supporting surface. A fluid jet cutting tool mounted above the supporting surface includes a jet nozzle directed toward the supporting surface for discharging a high velocity fluid jet stream to impinge upon material supported thereon. The apparatus also includes controlled positioning means for moving the fluid jet cutting tool relative to the material to be cut.

DETAILED DESCRIPTION OF PREFERRED EMBODIMENTS

Figure 1:
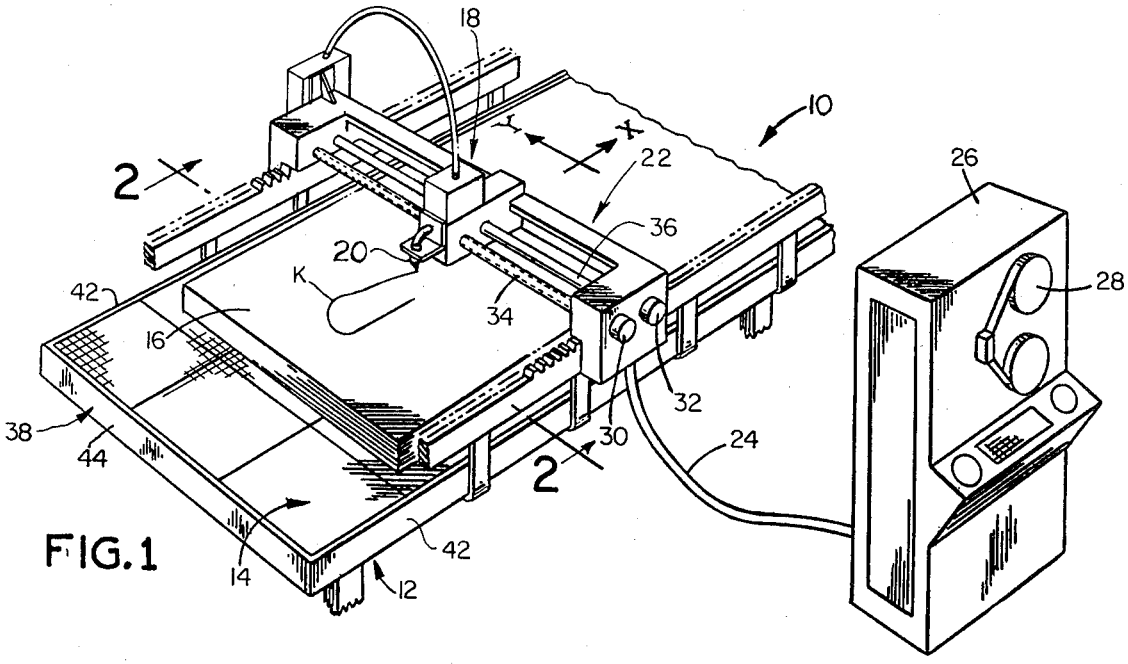
FIG. 1 is a perspective view of a computer-positioned fluid jet cutting apparatus embodying the present invention.
Figure 2:
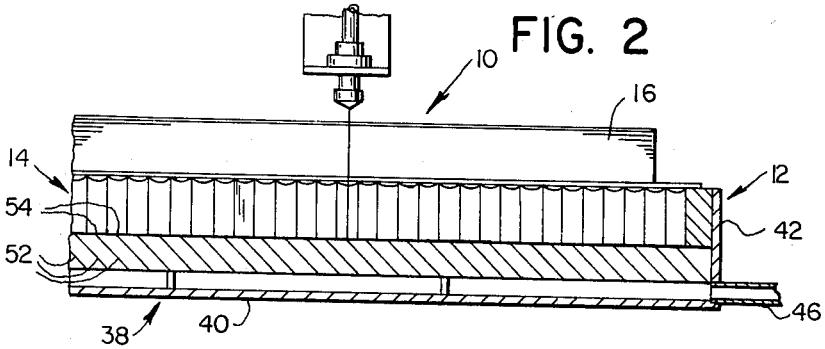
FIG. 2 is a somewhat enlarged fragmentary sectional view taken generally along the line 2—2 of FIG. 1.
Figure 3:
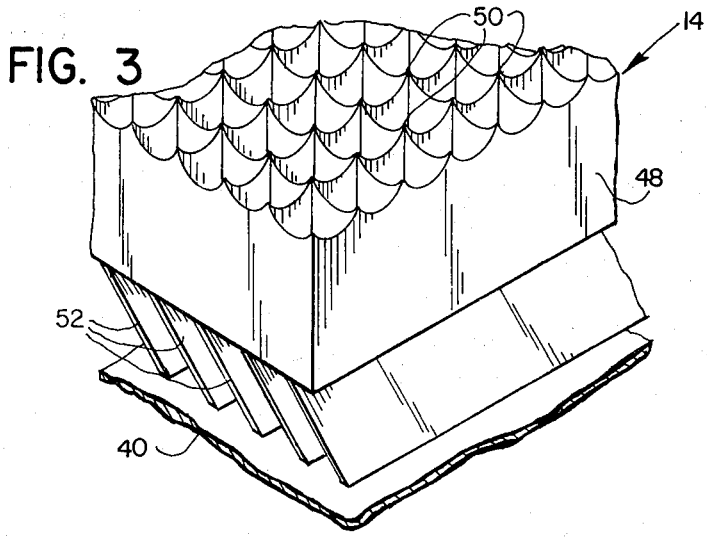
FIG. 3 is a somewhat further enlarged fragmentary perspective view of the bed plate assembly of FIGS. 1 and 2.

Referring now to the drawings and considering first particularly FIGS. 1-3, a fluid jet cutting apparatus embodying the present invention and indicated generally by the reference numeral 10 is particularly adapted for automated production cutting of sheet material. The apparatus 10 comprises a cutting table indicated generally at 12 which includes a bed assembly designated generally by the numeral 14. A lay-up of limp sheet material, indicated by the numeral 16, which may comprise a single sheet or several hundred sheets of woven or nonwoven fabric or like material supported in vertically stacked relation, is shown resting on the bed 14 which defines the supporting surface of the table 12. The apparatus 10 further includes a high velocity fluid jet cutting mechanism, indicated generally at 18, which has a jet nozzle 20 mounted on a movable carriage assembly designated generally by the numeral 22. The carriage assembly is supported on the cutting table 12 to move the nozzle 20 in longitudinal and transverse coordinate directions, as indicated by the X and Y coordinate axes, shown in FIG. 1, in response to control signals transmitted to the table through a control cable 24 from a programmable computer 26. The illustrated computer reads digital data from a program tape 28 which defines the contours of the cutting path. The jet nozzle 20 emits a high velocity fluid cutting jet, which impinges upon the lay-up 16 to form a kerf K, and moves in cutting engagement with the lay-up to cut patterns from it in response to control signals received from the computer 26. More specifically, the computer 26 transmits control signals to drive motors 30 and 32 which drive lead screws 34 and 36, respectively. The lead screw 34 moves the carriage assembly and the jet nozzle 20 longitudinally of the table 12 in one or the opposite X-coordinate direction, whereas the lead screw 36 moves the jet nozzle 20 on the carriage and transversely of the cutting table 12 in one or the opposite Y-coordinate direction.

Considering now the apparatus 10 in further detail, the cutting table 12 includes a generally rectangular upwardly opening base container or tank indicated generally at 38 which has a bottom wall 40, side walls 42, 42, and opposite end walls 44, 44, one shown in FIG. 1. A fluid drain conduit 46 associated with one wall of the tank communicates with the tank interior near its bottom, as shown in FIG. 2.

The bed assembly 14 is supported within the tank 38 and, as shown, comprises a piece of light gauge honeycomb material 48 supported in the tank with its cells opening in an upward direction. A typical bed assembly may be made from 0.003 inch stainless steel honeycomb material. The upper edges of the walls of the honeycomb are serrated or scalloped, as best shown in FIG. 3, to define a plurality of sharp upper portions or points 50 which occur at intersections of the honeycomb walls. The points 50, 50 are disposed in a common horizontal plane and define the material supporting surface of the table 12, as best shown in FIG. 2. The cross sectional configuration of the honeycomb cells may vary, but preferably, the cells are relatively small and may, for example, have a ⅛ inch width. In the illustrated embodiment, each honeycomb cell has a generally square cross section, as viewed from above, however, it should be understood that the invention may be practiced with honeycomb materials which have other cell configurations.

The illustrated bed assembly 14 further includes a plurality of parallel deflector plates 52, 52 which are inclined downwardly in one direction from the horizontal and which extend transversely of the tank 38 between the side walls 42, 42. The upper edge of each deflector plate 52 may be aligned with the lower edge of an associated wall of the honeycomb 48, but preferably, and as shown the upper wall of each deflector plate is disposed intermediate an associated pair of parallel honeycomb walls. Preferably, and as shown, each deflector plate 52 has an upper knife edge 54. The latter plates are preferably supported in the tank in spaced relation to the bottom wall so that cutting liquid collected in the tank may flow freely around the plates to drain from the tank through the drain outlet 46.

The fluid jet cutting mechanism 18 is of a type well known in the art and has suitable hydraulic pressurizing mechanism for delivering a steady stream of cutting fluid under pressure to the nozzle 20. More specifically, the fluid jet cutting apparatus 18 may comprise an intensifier pump (not shown) for delivering fluid under pressure and a pressure smoothing accumulator (not shown) which smoothes the pressure pulsations from the pump to supply cutting fluid to the nozzle 20 at a substantially constant pressure, which may, for example, be in the range from 10,000 to 100,000 psi. A typical nozzle may, for example, have a throat aperture in a range of 0.004 to 0.016 inches so that an extremely fine high velocity stream emanates from the nozzle and is capable of penetrating and cutting through a multiply lay-up of cloth, plastic, leather or other material to be cut.

When the material to be cut is supported on the table 12 or more specifically on the honeycomb 48, only the points 50, 50 which define the work surface of the table are in contact with the material. The cutting nozzle 20 moves with the carriage 22 and relative thereto in response to signals received from the computer 26 to form a kerf K, as shown in FIG. 1.

If the desired uniformity of cut is to be attained, it is essential that the fluid cutting jet have considerable residual energy as it emerges from the lowermost ply of the lay-up. This residual energy poses a potential source of wear and backsplash damage to the apparatus and more particularly to the lay-up supporting surface, however, in accordance with the present invention the material supporting surface which is defined by the sharp upper portions or point 50, 50 of the honeycomb serve to split the jet or defuse it, thereby substantially decreasing its remaining energy. The jet may also impinge upon the sharp upper edges of the honeycomb walls which also tend to dissipate its energy. Since the upper edges of the honeycomb walls are serrated or scalloped the fluid jet stream must travel some additional distance after passing through the lowermost layer of material and before impinging upon an associated honeycomb wall. This additional free travel distance tends to further dissipate jet energy before the jet impinges upon an associated honeycomb wall. Further, the cutting jet is captured in the relatively small cells of the honeycomb as it moves in cutting engagement with the lay-up so that backsplash, which can damage the lowermost plies of the lay-up, is substantially eliminated. If desired, a sheet of expendable plastic material or the like may be laid on the table surface before the lay-up is positioned on the table. This expendable sheet serves as a barrier layer to further reduce risk of material damage from fluid jet backsplash. Spent cutting fluid may be collected in the tank 38 and drained from the tank through the fluid conduit 46 for recirculation within the apparatus or discharged to a suitable waste drain, as when an expendable cutting fluid such as water is employed.

Figure 4:
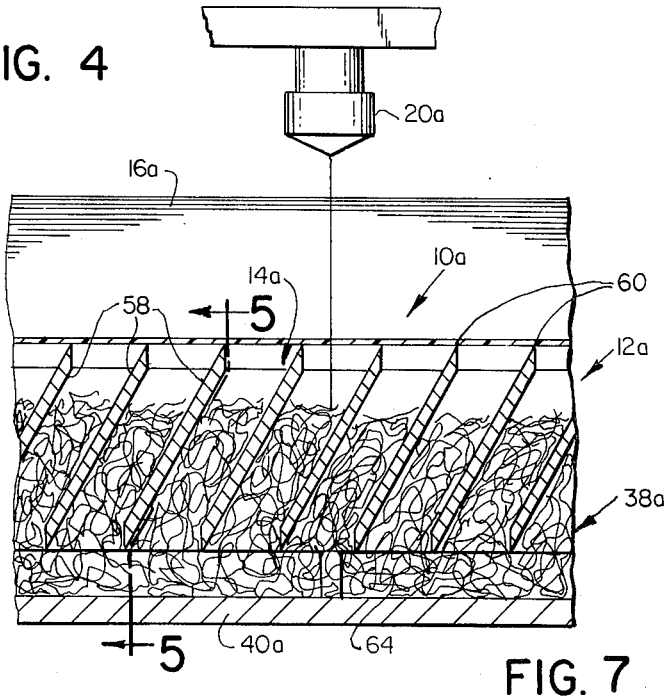
FIG. 4 is a somewhat enlarged fragmentary sectional view similar to FIG. 2, but shows another embodiment of the invention.
Figure 5:
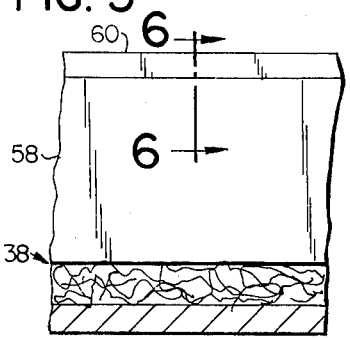
FIG. 5 is a fragmentary sectional view taken generally along the line 5—5 of FIG. 4.
Figure 6:
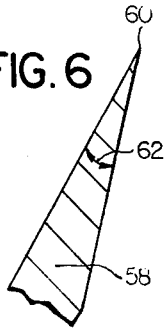
FIG. 6 is a somewhat further enlarged fragmentary sectional view taken along the line 6—6 of FIG. 5.

Referring now particularly to FIGS. 4 and 5, another apparatus embodying the present invention is indicated generally by the numeral **10*a*. The apparatus 10*a* is similar in most respects to the apparatus 10 previously described, and has a cutting table 12*a* which includes a base container or tank 38*a*. However, the apparatus 10*a* differs from the previously described apparatus 10 in the construction and arrangement of its bed assembly 14*a*. More specifically, the apparatus 10*a* includes a bed assembly 14*a* formed by a plurality of bars or plates 58, 58 which extend transversely of the tank 38*a*. Each plate 58 is generally rectangular and has an upper knife edge 60 which extends transversely of the tank as best shown in FIG. 5. The plates are inclined downwardly in one direction, substantially as shown in FIG. 4. The opposite surfaces of the plate which define the upper edge 60 form an included angle in the range of 5° to 10°, as best shown in FIG. 6, wherein the included angle between the edge surfaces is indicated at 62. The knife edge portions 60, 60 are disposed in a common generally horizontally plane to define the material supporting surface of the table 12*a*. When the jet stream of cutting fluid from the jet nozzle 20*a* (FIG. 4) impinges upon the sharp upper edge 60 of one of the plates, the jet stream is split by the latter edge and looses a substantial amount of its residual energy. The spent cutting jet fluid is captured between the relatively closely spaced plates. The inclined arrangement of the plates further serves to prevent backsplash which may damage the lower layers of material in a lay-up supported on the bed 14*a*. If desired, suitable energy absorbing material may be provided for further absorbing the energy from the spent fluid cutting jet. In the illustrated embodiment 10*a*, metal wool indicated at 64 is contained within the lower portion of the tank 38*a* and in spaces between the plates 58, 58 for absorbing energy from the fluid cutting jet. The latter material effectively reduces backsplash, attenuates noise and prevents excessive wear on the plates 58, 58 without substantially impairing fluid drainage from the tank 38*a***.

Figure 7:
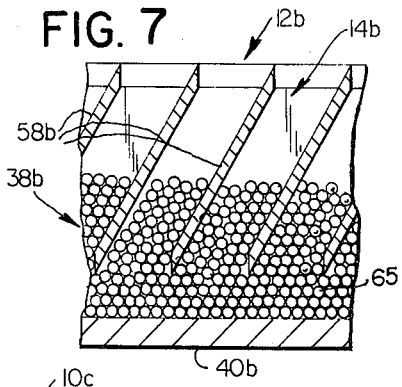
FIG. 7 is a fragmentary sectional view similar to FIG. 4 and shows still another embodiment of the invention.

In FIG. 7 there is shown a further embodiment of the invention which is indicated at **10*b*. The apparatus 10*b* has a cutting table 12*a* which includes a bed assembly 14*b*. The bed assembly 14*b* differs from the bed assembly 14*a* previously described only in that steel shot 65**, arranged substantially as shown, is used in place of metal wool as an energy absorbing media.

Figure 8:
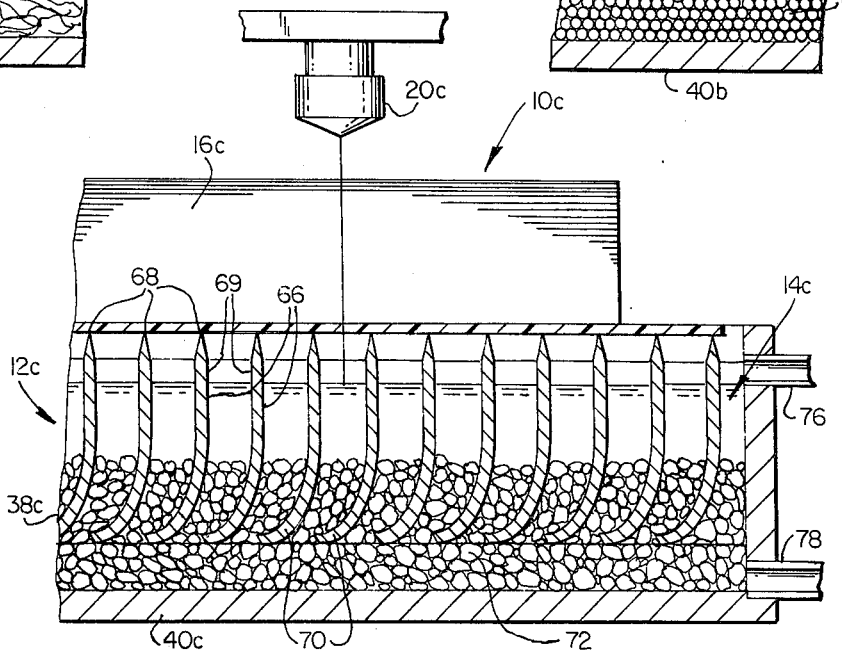
FIG. 8 is a fragmentary sectional view similar to FIG. 4 and shows a further embodiment of the invention.

In FIG. 8 still another embodiment of the invention is illustrated and indicated generally at **10*c*. The apparatus 10*c* includes a cutting table 12*c* which has a base tank 38*c*. A bed assembly indicated at 14*c* supported in the tank comprises a plurality of generally parallel, closely spaced plates 66, 66 which extend transversely of the tank 38*c*. In accordance with the invention, each plate 66 has a sharp upper knife edge 68 defined by surfaces which form an included angle of from 5° to 10°, substantially as shown in FIG. 8. Each plate 66 has an upper portion 69 which lies generally within a vertical plane, however, the lower portion of each plate, designated at 70, curves arcuately downwardly and in one direction to provide a jet stream deflecting surface. As in the previously described embodiment, energy absorbing material is contained within the tank 38***c*; however, in this instance the energy absorbing material comprises loosely packed gravel 72 which serves to absorb jet energy. If desired, the tank may also contain an energy absorbing liquid 74 which preferably comprises cutting fluid. The liquid 74 may be maintained at a substantially constant level by the provision of liquid inlet and outlet conduits, indicated at 76 and 78, respectively, and which may include suitable inlet and outlet valves (not shown) which may be regulated to maintain a desired liquid level within the tank 38*c* at all times. If desired, the energy absorbing liquid may comprise jet cutting fluid.

I claim:

1. Fluid jet cutting apparatus comprising a bed assembly including a plurality of spaced apart members having sharp upper portions disposed in a common generally horizontal plane and defining a fluid permeable sheet material supporting surface, a fluid jet cutting tool mounted above said supporting surface and including a jet nozzle directed toward said fluid permeable supporting surface for discharging a high velocity stream of cutting fluid to impinge upon material supported on said fluid permeable supporting surface, and controlled positioning means for moving said fluid jet cutting tool relative to said fluid permeable supporting surface with said jet nozzle directed toward said fluid permeable supporting surface.

2. Fluid jet cutting apparatus as set forth in claim 1 wherein said bed members comprise bed plates having upwardly facing knife edges which define said sharp upper portions.

3. Fluid jet cutting apparatus as set forth in claim 2 wherein said bed plates comprise elongated parallel horizontally extending plates.

4. A fluid jet cutting apparatus as set forth in claim 3 wherein said bed plates are vertically inclined.

5. Fluid jet cutting apparatus as set forth in claim 2 wherein each of said knife edges is further characterized as a serrated knife edge which defines points and said points comprise said sharp upper portions.

6. Fluid jet cutting apparatus as set forth in claim 2 wherein each of said bed plates has a vertically disposed upper portion and a lower portion contiguous to said upper portion and inclined downwardly and in one direction away from said upper portion.

7. Fluid jet cutting apparatus as set forth in claim 6 wherein said lower portion curves arcuately downwardly and away from said upper portion.

8. Fluid jet cutting apparatus as set forth in claim 2 wherein each of said bed plates is generally vertically disposed and extends transversely of said bed and said bed plate assembly includes a plurality of spaced apart deflector plates located below said bed plates, each of said deflector plates being downwardly inclined in one direction and having an upper edge extending transversely of said bed and located intermediate a pair of adjacent bed plates.

9. Fluid jet cutting apparatus as set forth in claim 1 wherein said upper edges are further characterized as rectilinear knife edges.

10. Fluid jet cutting apparatus as set forth in claim 1 wherein said bed assembly comprises a honeycomb grid having vertically disposed intersecting walls defining a multiplicity of vertically extending cells and said sharp upper edge portions.

11. Fluid jet cutting apparatus as set forth in claim 10 wherein said walls having serrated upper edges which define a multiplicity of upwardly facing points which comprise said sharp upper portions.

12. Fluid jet cutting apparatus as set forth in claim 11 wherein said points are disposed at intersections of said walls.

13. Fluid jet cutting apparatus as set forth in claim 10 wherein said bed assembly includes a plurality of parallel horizontally extending deflector plates disposed below said grid and inclined downwardly from said grid.

14. Fluid jet cutting apparatus as set forth in claim 13 wherein each of said deflector plates has a sharp upper edge portion.

15. Fluid jet cutting apparatus as set forth in claim 13 wherein the upper edge portions of said plates are disposed generally adjacent the lower surface of said grid.

16. Fluid jet cutting apparatus as set forth in claim 13 wherein the upper edge of each deflector plate is vertically aligned between a pair of generally parallel walls of said honeycomb grid.

17. Fluid jet cutting apparatus as set forth in claim 1 including fluid energy absorbing means below said supporting surface and in the path of said high velocity stream for absorbing energy from said stream.

18. Fluid jet cutting apparatus as set forth in claim 17 wherein said fluid energy absorbing means is disposed in spaces between said bed members.

19. Fluid jet cutting apparatus as set forth in claim 18 wherein said bed assembly includes a base container and said bed members are disposed within said base container.

20. Fluid jet cutting apparatus as set forth in claim 19 wherein said fluid energy absorbing means comprises metal wool.

21. Fluid jet cutting apparatus as set forth in claim 19 wherein said energy absorbing means comprises gravel.

22. Fluid jet cutting apparatus as set forth in claim 19 wherein said energy absorbing means comprises shot.

23. Fluid jet cutting apparatus as set forth in claim 19 wherein said energy absorbing means comprises a quantity of liquid in said container.

* * * * *

UNITED STATES PATENT OFFICE

CERTIFICATE OF CORRECTION

Patent No. 4,112,797 Dated September 12, 1978

Inventor(s) David R. Pearl

It is certified that error appears in the above-identified patent and that said Letters Patent are hereby corrected as shown below:

Column 3, line 30, after "10,000" insert --psi--.

Column 3, line 31, after "0.004" insert --inches--.

Signed and Sealed this

*Twenty-seventh* Day of *February 1979*

[SEAL]

*Attest:*

RUTH C. MASON
*Attesting Officer*

DONALD W. BANNER
*Commissioner of Patents and Trademarks*

Disclaimer 4,112,797.—*David R. Pearl,* West Hartford, Conn. FLUID JET CUTTING APPARATUS. Patent dated Sept. 12, 1978. Disclaimer filed Feb. 4, 1982, by the assignee, *Gerber Garment Technology, Inc.*

Hereby enters this disclaimer to claims 1, 2, 3, 4, 6, 9, 10, 17, 18, 19 and 23 of said patent.

[*Official Gazette May 4, 1982.*]